United States Patent [19]

Andreadakis

[11] Patent Number: 4,518,894

[45] Date of Patent: May 21, 1985

[54] DISPLAY PANEL HAVING MEMORY

[75] Inventor: Nicholas C. Andreadakis, Branchburg, N.J.

[73] Assignee: Burroughs Corporation, Detroit, Mich.

[21] Appl. No.: 395,696

[22] Filed: Jul. 6, 1982

[51] Int. Cl.[3] ..... H01J 17/04; H01J 61/04; H01J 61/54

[52] U.S. Cl. ..... 313/491; 313/582; 313/584; 313/586

[58] Field of Search ..... 313/491, 493, 582, 584, 313/585, 586, 583; 340/714, 769, 771

[56] References Cited

U.S. PATENT DOCUMENTS

| | | | |
|---|---|---|---|
| 4,103,206 | 7/1978 | Eto et al. | 313/582 X |
| 4,112,329 | 9/1978 | Veith | 313/585 X |
| 4,329,616 | 5/1982 | Holz et al. | 340/771 X |

*Primary Examiner*—David K. Moore

*Assistant Examiner*—K. Wieder

*Attorney, Agent, or Firm*—Kevin R. Peterson; Edmund M. Chung; Robert A. Green

[57] ABSTRACT

A display panel comprising a gas-filled envelope containing an array of rows and columns of D.C. scan/address cells, each scan/address cell including a volume of gas and an anode electrode and a cathode electrode, and an array of rows and columns of display cells, each display cell including a volume of gas and two electrodes, one electrode being in the form of an apertured plate whose apertures are the display cells, the other electrode being an apertured electrode whose apertures are considerably smaller than the apertures in the one electrode and so numerous that the greater portion of the area of the other electrode is light-transmissive whereby the human eye does not see the solid portions of the other electrode which define the apertures therein.

3 Claims, 3 Drawing Figures

DISPLAY PANEL HAVING MEMORY

BACKGROUND OF THE INVENTION

A recently invented display panel which comprises a dot matrix display having memory is relatively complex and includes several support plates and electrode arrays which must be prepared and assembled accurately. In particular, the panel has a rather complex face plate assembly which is the memory portion of the panel. This panel is described and claimed in copending application Ser. No. 051,313, filed June 22, 1979 now U.S. Pat. No. 4,386,348 and U.S. Pat. No. 4,329,616, dated May 11, 1982, both of George E. Holz and James A. Ogle.

The present invention relates to improvements in the panel, particularly in the face plate portion thereof, and its preparation.

DESCRIPTION OF THE INVENTION

The present invention is embodied in a display panel 10 of the type described and claimed in copending application of George E. Holz and James A. Ogle, Ser. No. 051,313, filed June 22, 1979 now U.S. Pat. No. 4,386,348 and U.S. Pat. No. 4,329,616, dated May 11, 1982, both incorporated herein by reference, along with the patents and publications cited therein. This application and patent both describe a dot matrix memory display panel including a D.C. scanning portion and an A.C. display portion.

Figure 1:
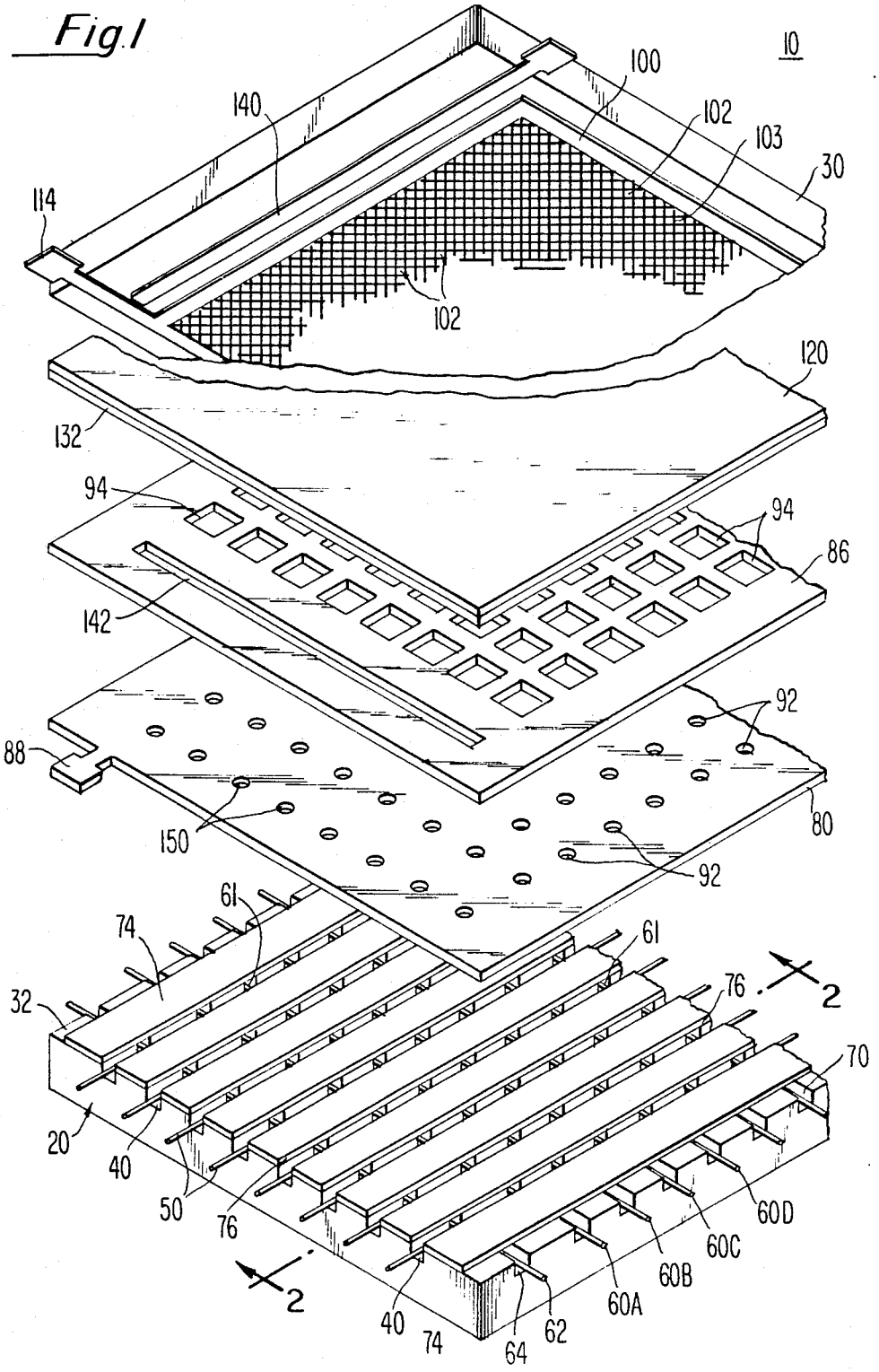
FIG. 1 is a perspective exploded view of a display panel embodying the invention.
Figure 2:
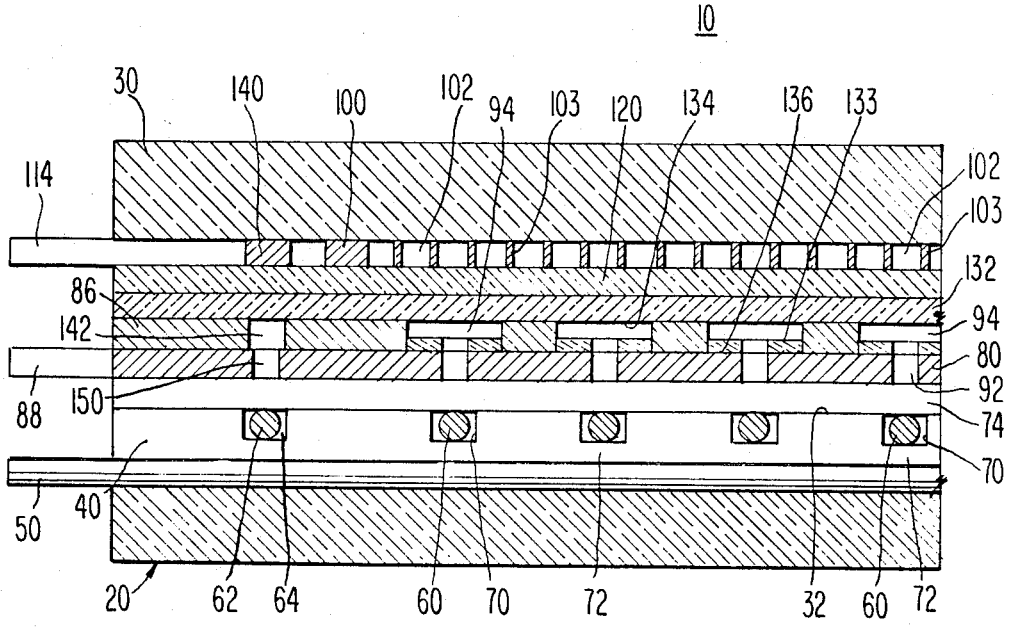
FIG. 2 is a sectional view through the panel of FIG. 1 along lines 2—2, with the panel shown assembled.

The display panel 10 includes a gas-filled envelope made up of an insulating base plate or substrate 20 and a glass face plate 30, which is shown tilted up and rotated to the left in FIG. 1 to present a view of its interior surface. These plates are hermetically sealed together, as illustrated in FIG. 2, along a closed periphery which surrounds the operating inner portion of the panel and the various gas cells provided therein. The base plate has a top surface 32, in which a plurality of relatively deep parallel longitudinal slots 40 are formed and in each of which a scan/address anode electrode, for example a wire 50, is seated and secured.

A plurality of scan cathode electrodes in the form of wires 60 are seated in relatively shallow slots 70 in the top surface of the base plate. The slots 70 and scan cathodes 60 are disposed transverse to the slots 40 and scan anodes 50, and each crossing of a scan cathode 60 and a scan anode 40 defines a scanning cell 72 (FIG. 2). It can be seen that the scanning cells are arrayed in rows and columns. More specifically, the cathode portions 61, the underlying portions of anodes 50, and the intermediate gaseous regions define the scanning cells.

The scan cathodes 60A, B, C, etc., form a series of cathodes which can be energized serially in a scanning cycle, with cathode 60A being the first cathode energized in the scanning cycle.

A reset cathode electrode 62 is disposed in a slot 64 in the top surface of the base plate adjacent to the first scan cathode 60A, so that, when it is energized, it provides excited particles for cathode 60A at the beginning of a scanning cycle to be described. Where the reset cathode crosses each scan anode, a reset cell is formed, and the crossing of all of the scan anodes by the reset cathode provides a column of reset cells. These reset cells are turned on or energized at the beginning of each scanning cycle, and they expedite the turn-on of the first column of scanning cells associated with the first cathode 60A.

In the panel 10, it is desirable that the cathodes 60, or at least the portions 61 thereof which are disposed in the scanning cells, be spaced uniformly from an electrode 80 positioned above the cathodes and described below. Thus, the cathode grooves or slots 70 must be of uniform depth. It is also desirable to provide means for preventing the spread of cathode glow from the operating portions 61 of the cathodes to the intermediate portions. These conditions may be satisfied by providing a thin slotted insulating sheet or layer 74 on the top surface of the base plate 20. The slots 76 in the sheet 74 are aligned with the anode slots 40 and overlie the portions 61 of the cathodes 60. The lower surface of the sheet 74 either touches the intermediate portions of the cathodes or is so close to these portions that cathode glow does not spread along the cathodes from one operating portion 61 to the next. Alternatively, sheet 74 can have a separate aperture for each cathode portion 61, rather than slots 76, and it can advantageously be formed as a screen printed layer, rather than a sheet.

The portions of the panel described up to this point comprise the base plate assembly. This is the D.C. portion and the scanning and addressing portion of the panel.

Adjacent to the base plate assembly is the second portion of the panel which is a quasi A.C. assembly; that is, it includes A.C. and D.C. features. This portion of the panel includes an electrode in the form of a thin metal plate 80 (known as the priming plate) having an array of rows and columns of relatively small apertures 92, each overlying one of the scanning cells. The plate 80 is positioned close to cathodes 60 and may be seated on insulating sheet 74. Electrode plate 80 includes a terminal 88 for making electrical connection thereto.

Adjacent to plate 80, and preferably in contact with the upper surface thereof, is an apertured plate or layer 86 (known as the glow isolator) having rows and columns of apertures 94 which are considerably larger than apertures 92. The apertures 94 comprise the display cells of panel 10. The sheet 86 may be of insulating material, as shown in FIG. 2, or it may be of metal, and, if it is of metal, the plates 80 and 86 may be made in one piece.

In panels of the type described herein, in the past, the face plate assembly has included the glass plate 30 having a large-area transparent electrode formed on its inner surface. An array of parallel horizontal conductors was formed on the inner surface of the large-area transparent conductors, and then, in order, layers of glass and magnesium oxide were provided. In addition, an opaque apertured insulating mask was disposed between the glow isolator plate 86 and the layer of magnesium oxide. In this system, the opaque conductors, the openings in the apertured mask and the display cells 94 were aligned and dimensioned so that there was no interference with the display cells 94. To this end, the apertures in the apertured insulating mask were of the same size and shape as the apertures 94 in the glow isolator plate 86, and the horizontal conductors were spaced apart so that they did not cross display cells 94. It can be seen that accurate manufacture of this face plate assembly and accurate alignment of the face plate assembly with the plate 86 and display cells 94 are required. These operations can be carried out satisfactorily, and panels of this type are made and operate well. However, the present invention simplifies the structure and manufacture of the face plate assembly.

Figure 3:
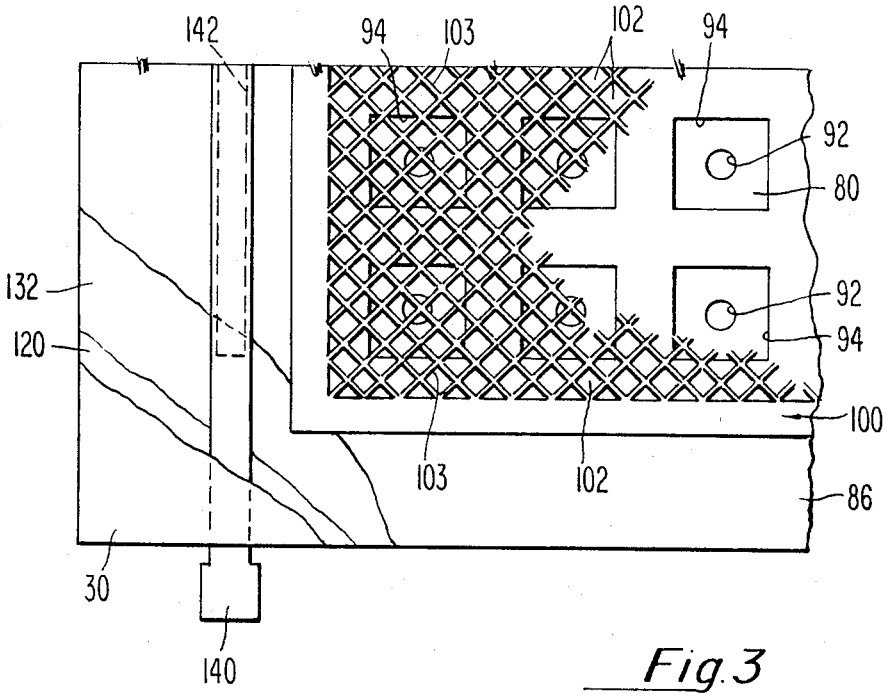
FIG. 3 is a plan view of the panel of FIG. 1 looking into the face plate.

According to the method of the invention, the face plate assembly includes the glass face plate 30, on the inner surface of which is secured a layer 100 of a photoetchable metallic sheet such as a laminated assembly of stainless steel-copper-stainless steel. Other metal composites such as chrome-copper-chrome may also be used. Layers of one metal may also be used. This assembly is coated with a photoresist, suitably exposed through a mask, developed, and then etched to provide a mask electrode having a pattern of apertures 102 shown in FIGS. 1 and 3. The apertures or openings 102 in mask 100 are considerably smaller than the apertures 94 in the plate 86. In one arrangement, these apertures 102 were 0.004 inch square, and the plate apertures 94 were 0.014 inch×0.022 inch. In addition, the rows of apertures 102, or the solid lines 103 which define the apertures, are slanted at approximately an angle of 22° to the horizontal.

The openings 102 should be sufficiently numerous so that the eye does not see the solid portions 103 which surround the openings. Typically, if the open area defined by the openings is at least 60% of the area of the display cell 94, the light output from the display cell 94 will not be obstructed as far as the human eye is concerned. In addition, since the solid portions 103 of the electrode 100 are at an angle and they are necessarily relatively narrow, they will not have an obstructing effect on the visibility of the display cell.

With this arrangement, the alignment of the face plate assembly with the plate 86 is not critical, since the function of the human eye is such that the solid, opaque portions 103 of the apertured mask electrode 100 cannot interfere with the viewability of the display cells 94.

The mask 100 is provided with a terminal 114.

The remainder of the face plate assembly includes a transparent insulating coating 120 of glass or the like covering mask electrode 100, and, if desired, a dielectric layer 132 of magnesium oxide, thorium oxide, or the like is coated on layer 120.

In panel 10, the apertures 94 in glow isolator plate 86 comprise display cells, and, as can be seen in FIG. 2, each display cell has one end wall 134 formed by a portion of insulating layer 132, and an opposite end wall 136 formed by a portion of the top surface of plate 80. To provide cell uniformity and to minimize cathode sputtering, a coating of the material of layer 132 should also be provided on the base or lower wall 136 of each display cell 94, such as the layer 133 shown in FIG. 2.

Panel 10 has a keep-alive arrangement which includes an A.C. electrode 140 in the form of a linear conductive film or layer of opaque metal, such as silver, provided on the inner surface of the face plate 30 adjacent to one edge of the transparent conductive electrode 100. The A.C. keep-alive electrode 140 is positioned so that it is in optimum operative relation with the column of reset cells and reset cathode 62, to which it supplies excited particles. The A.C. keep-alive electrode 140 is covered by the insulating layers 120 and 132. The plate 86 is provided with a slot 142, and plate 80 is provided with a column of holes 150, the slot 142 overlying and being aligned with the column of holes 150, and both lie beneath and are aligned with the A.C. electrode 140. The slot 142 in the plate 86 is narrower than the opaque A.C. slectrode 140 so that a viewer, looking through face plate 30, cannot see any glow which is present in slot 142 and holes 150. Electrode 140 operates with plate 80 to produce glow discharge between them and produce excited particles in slot 142 and holes 150. These excited particles are available to the reset cathode 62 and assist the firing of the column of reset cells.

The gas filling in panel 10 is preferably a Penning gas mixture of, for example, neon and a small percentage of xenon, at a pressure of about 400 Torr. When the panel has been constructed and evacuated, the gas filling is introduced through a tubulation 24 secured to base plate 20 (FIG. 2), or a non-tubulated construction can be employed.

The operation of the panel 10 is not set forth in detail herein since it is described in detail in the above-mentioned applications. However, a brief description of the panel operation is as follows: With the keep-alive electrodes generating excited particles, and with operating potential applied to the scan anodes 50, the reset cathode 62 is energized to fire the column of reset cells, and then the scan cathodes 60 are energized sequentially to carry out a scanning operation in the lower portion of the panel. At the same time, with sustaining pulses applied between the electrodes 80 and 100, as each column of scan cells is energized, information or display signals are applied to the proper scan anodes 50 to cause glow to develop in the associated display cells 94 where it is sustained by the sustaining pulses. When all of the columns of scan cells have been energized and the appropriate associated display cells have been energized, a sustained and visible message is present in the upper display portion of the panel.

What is claimed is:

1. A gas-filled memory display panel comprising a gas-filled envelope made up of a base plate and a face plate hermetically sealed together, a layer of rows and columns of scan/address cells disposed adjacent to said base plate, each scan/address cell comprising a volume of gas and an anode electrode and a cathode electrode, a layer of rows and columns of display cells adjacent to said layer of scan/address cells, said display cells having as their components:

a first apertured plate electrode disposed adjacent to said layer of scan/address cells, the apertures in said first apertured plate electrode being small holes each in operative relation with a scan/address cell, a second apertured plate seated on said first plate with its apertures being larger than the apertures in said first plate and comprising the display cells of the panel and each being in operative relation with one of the apertures in said first apertured plate, the face plate carrying on its inner surface a large-area apertured A.C. electrode which is in the nature of a mesh and is covered by a layer of insulating material whereby said apertured electrode is insulated from the gas in the panel and thus operates as an A.C. electrode, the apertures in said A.C. apertured electrode being considerably smaller than the display cell apertures in said second apertured plate and so numerous that the eye sees substantially all light output from a display cell which is emitting light, the solid portions of said A.C. apertured electrode which define the apertures therein comprising fine conductors which are parallel to each other but are disposed at an angle to the rows and columns of display cells, so that the rows and columns of apertures in said A.C. mesh electrode are disposed at an angle to the rows and columns of display cells, the combination of the angular orientation of said solid portions of said A.C. electrode and the presence of large numbers of apertures therein for each display cell making it unnecessary to critically align said A.C. electrode and said second apertured plate and its display cells, said A.C. electrode serving as a sustaining electrode and having sustaining signals coupled between it and said first conductive plate whereby said A.C. electrode serves both to apply electrical sustaining signals to said display cells and to provide aperture definition for said display cells, said scan/address cells being adapted to be scanned sequentially column by column, with selected cells being energizable at the same time to cause excited particles therein to flow through apertures in said first apertured plate and into the associated display cell in said second apertured plate and onto the walls thereof to form wall charge which combines with said sustaining signals, applied across said display cells between said A.C. electrode and said first apertured plate electrode, to cause and sustain glow in said display cells, all of the display cells energized in all of the columns of display cells combining to display a message.

2. The display panel defined in claim 1 wherein said A.C. mesh electrode is covered with a layer of glass.

3. The display panel defined in claim 1 wherein said A.C. mesh electrode is covered with a layer of glass, and the layer of glass is coated with a layer of magnesium oxide, said second apertured plate and its display cells being in contact with the face plate and said layer of magnesium oxide whereby said layer of magnesium oxide comprises an end wall of each display cell on which excited particles impinge when glow is transferred from a scan/address cell in the process of turning on a display cell.

* * * * *